US006907940B1

(12) United States Patent
Ahlers

(10) Patent No.: US 6,907,940 B1
(45) Date of Patent: Jun. 21, 2005

(54) FAST RESPONSE FLUID FLOW CONTROL VALVE/NOZZLE

(75) Inventor: Jeffrey Ahlers, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 92 days.

(21) Appl. No.: 10/662,169

(22) Filed: Sep. 11, 2003

(51) Int. Cl.[7] ..... A62C 37/14
(52) U.S. Cl. ..... 169/58; 169/28; 239/590
(58) Field of Search ..... 239/309, 590; 169/58, 6, 11, 12, 27, 28, 29

(56) References Cited

U.S. PATENT DOCUMENTS

| | | | | | |
|---|---|---|---|---|---|
| 3,762,479 | A | * | 10/1973 | Fike et al. | 169/28 |
| 3,820,607 | A | | 6/1974 | Mikey | 169/58 |
| 3,834,463 | A | * | 9/1974 | Allard et al. | 169/28 |
| 3,915,236 | A | * | 10/1975 | Stichling | 169/61 |
| 4,006,780 | A | | 2/1977 | Zehr | 169/26 |
| 4,046,156 | A | * | 9/1977 | Cook | 137/68.13 |
| 4,126,184 | A | * | 11/1978 | Hinrichs | 169/56 |
| 4,245,660 | A | * | 1/1981 | Roznieck i | 137/68.13 |
| 4,313,501 | A | | 2/1982 | Eckert | 169/58 |
| 4,896,728 | A | | 1/1990 | Wolff et al. | 169/37 |
| 5,031,701 | A | | 7/1991 | McLelland et al. | 169/58 |
| 5,094,298 | A | | 3/1992 | Polan | 169/41 |
| 5,232,053 | A | | 8/1993 | Gillis et al. | 169/58 |
| 5,234,059 | A | | 8/1993 | Eynon | 169/39 |
| 5,291,952 | A | * | 3/1994 | Arend | 169/71 |
| 5,458,202 | A | | 10/1995 | Fellows et al. | 169/58 |
| 5,494,114 | A | | 2/1996 | Hoening et al. | 169/38 |
| 5,647,438 | A | | 7/1997 | Chatrathi et al. | 169/58 |
| 5,829,532 | A | | 11/1998 | Meyer et al. | 169/37 |
| 6,006,842 | A | * | 12/1999 | Stilwell et al. | 169/60 |
| 6,123,153 | A | | 9/2000 | Finnegan | 169/37 |
| 6,209,654 | B1 | | 4/2001 | Curless | 169/17 |
| 6,341,616 | B1 | | 1/2002 | Taylor | 137/68.12 |

* cited by examiner

*Primary Examiner*—Christopher Kim
(74) *Attorney, Agent, or Firm*—Mark Homer; James M. Kasischke; Michael F. Oglo

(57) ABSTRACT

Disclosed herein is a fast response fluid flow control valve/nozzle that combines the technology used to rupture the frangible discs found in pressurized container-based fire protection/suppression systems with that found in fixed pipe spray/sprinkler systems. The apparatus' design projects a small, localized pressure wave at the underside of a frangible disc that is sufficient to rupture the disc in a very rapid manner. The present invention generally comprises an assembly of six primary components; a chamber base, a jet core threaded into the chamber base, a commercially-available rupture/frangible disc assembly, a disc retention ring, a nozzle port threaded onto the chamber base to hold the retention ring and rupture disc against the jet core and to tie the components together as a unitized assembly, and a pressure cartridge actuator.

13 Claims, 6 Drawing Sheets

A

B

B

A

FAST RESPONSE FLUID FLOW CONTROL VALVE/NOZZLE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention relates to high-speed fire protection/suppression systems and, more particularly, to fast response fluid flow control nozzles incorporating a frangible element that is designed to be ruptured to release said material.

2. Description of the Background

The ongoing development of increasingly hazardous (i.e. energetic or explosive) materials requires concurrent improvements in the safety systems associated with their handling and storage. High-speed fire protection/suppression systems represent one of the most important safety systems associated with those evolving materials. High-speed fire protection/suppression systems take a number of forms. Common forms include (1) fixed pipe pilot-actuated spraying/sprinkler systems incorporating poppet valve-based nozzle assemblies and (2) pressurized containers of fire extinguishing/suppressing material (e.g. water) in combination with some means of fire detection. As one might expect, both forms possess certain pros and cons.

Pressurized containers have been historically used for the discharge of fire suppression agents in explosion suppression systems. Testing conducted by the Fire Research Laboratory at Tyndall Air Force Base has demonstrated that a pressurized container-based system, in this case a spherical container, can provide a significantly faster response time, in discharging a fire extinguishing/suppressing material to control various fire-related hazards, than a pilot-actuated spraying/sprinkler system. However, the limited, or finite, volume of fire extinguishing/suppressing material present in a pressurized container-based system, as opposed to the essentially unlimited supply available with a fixed pipe pilot-actuated spraying/sprinkler system, can be problematic. Additional deficiencies of pressurized container-based systems include (1) their typically bulky size/shape, (2) the significant cost and effort required to rearm/refill them, (3) their inability to be utilized/deployed in areas of limited size or accessibility, and (4) their initial purchase price.

The fast response time of a pressurized container-based system is generally provided by a fluid flow control valve incorporating a frangible element (e.g. a disc) and some means for rupturing that element upon the detection of a fire. The present invention is not the first to address the issue of fast response fluid flow control devices for fire protection/suppression systems. For example, U.S. Pat. No. 5,647,738 to Chatrathi et al., U.S. Pat. No. 5,458,202 to Fellows et al., U.S. Pat. No. 5,232,053 to Gillis et al., U.S. Pat. No. 5,031,701 to McLelland et al., U.S. Pat. No. 4,006,780 to Zehr, and U.S. Pat. No. 3,834,463 to Allard et al. disclose a variety of means for releasing the flow of a fire extinguishing/suppressing material via the rupturing of a frangible element.

U.S. Pat. No. 5,647,438 to Chatrathi et al. discloses an explosion suppressant dispersion nozzle for dispersing suppressant material from a pressurized suppressant storage vessel to a protected zone or room upon the rupturing of a frangible element by an actuator.

U.S. Pat. No. 5,458,202 to Fellows et al. discloses a pressurized extinguishant release device with a penetrator affixed to a rolling diaphragm. The penetrator is positioned above a frangible membrane that encloses a pressurized extinguishant. Heating of a liquid filled sensor tube to a certain temperature will cause vapor pressure to push against the diaphragm, causing a shear pin to fail, and propel the penetrator into the membrane and thus allow the extinguishant to flow.

U.S. Pat. No. 5,232,053 to Gillis et al. discloses an explosion protection system including a container with a discharge outlet adapted to contain an explosion suppressant under pressure, a frangible member covering the discharge outlet, an explosive charge disposed in the container adjacent to the frangible member and adapted to create explosive forces that rupture said member, and a somewhat compressible explosion suppressant retained under pressure.

U.S. Pat. No. 5,031,701 to McLelland et al. discloses a suppressant delivery and release nozzle structure for an explosion protection system. The nozzle is a reducing elbow, concentric or eccentric mounting a rupture disc at its small end. A selectively actuatable detonator housed in the nozzle adjacent the disc permits substantially instantaneous opening of the disc upon command for release and delivery of suppressant to a zone to be protected from an explosion hazard.

U.S. Pat. No. 4,006,780 to Zehr discloses a device for rupturing a pressurized cylinder containing a fire extinguishing product. When the temperature is high enough to melt a fusible link, a spring-loaded punch is forcibly propelled downwardly to rupture a frangible disc in the cylinder to allow the contents to be discharged.

U.S. Pat. No. 3,834,463 to Allard et al. discloses a sensitive sprinkler that includes a rupture disc valve positioned to block fluid flow through the flow path. An explosive squib is mounted in the fluid flow path upstream of the rupture disc so that when exploded an expansive gas directs a pressure through said fluid to rupture the disc. A fire detector assembly electrically activates the squib substantially immediately upon detection of a fire.

The ideal fire protection/suppression system would combine the fast response of a container-based system with the essentially unlimited extinguishing/suppressing material supply of a fixed pipe system. Unfortunately, due to the nature of fixed pipe fire protection/suppression systems, each of these prior art devices possesses certain limitations with respect to the specific needs addressed by the present invention. The Chatrathi et al., Gillis et al., McLelland et al., and Allard et al. patents incorporate the storage and use of an explosive device/detonator to rupture the frangible element. The use of any explosive device/detonator does provide the required activation speed of a system, however the type and size of the device being considered is essential as it may be exposed to highly energetic/explosive materials. Additionally, the Gillis et al. and Allard et al. patents operate in a manner that generates an omni-directional pressure wave that momentarily disrupts the outward flow of the fire suppressing material. With highly energetic/explosive materials, every fraction of a second counts and, therefore, any process that delays the outward flow of the fire suppressing material is one that must be eliminated. The Fellows et al. and Zehr patents disclose components used to rupture the frangible elements that are positioned within the flow pathway for the fire extinguishing/suppressing material. This configuration, in a best case scenario, results in a marginal occlusion of the orifice through which the fire extinguishing/suppressing material is meant to flow. In a worst case scenario, the orifice might become completely occluded.

Therefore, there remains a need for a fast response fluid flow control valve/nozzle incorporating a frangible element that is designed to be ruptured to release fire suppressant material from an essentially unlimited supply. While the use of an explosive or energetic actuator may be required to provide the required speed of activation of a system, significant consideration should be given to reducing the potential hazard. The fluid flow control valve/nozzle should also be scalable to provide for use in a variety of applications, fabricated of materials that provide the durability/longevity required by the nature of its use, capable of being retrofitted to existing fire protection/suppression systems, and economical to manufacture in order to provide for widespread use.

SUMMARY OF THE INVENTION

It is, therefore, the primary object of the present invention to provide a fast response fluid flow control valve/nozzle for use in high-speed fire protection/suppression systems of the type having an essentially unlimited supply of fire extinguishing/suppressing materials.

It is another object of the present invention to provide a fast response fluid flow control valve/nozzle with frangible element that cannot block, to any degree, the flow of the fire extinguishing/suppressing materials.

Yet another object of the present invention is to provide a fast response fluid flow control valve/nozzle with a frangible element for use in high-speed fire protection/suppression systems that controls and significantly reduces the hazard introduced by the actuator into the protected area to break the frangible element.

It is another object of the present invention to provide improved fast response fluid flow control valves/nozzles for use in high-speed fire protection/suppression systems that are scalable to provide for use in a variety of applications.

Another object of the present invention is to provide improved fast response flow control apparatus for use in high-speed fire protection/suppression systems that are fabricated of materials that provide the durability/longevity required by the nature of its use.

Yet another object of the present invention is to provide improved fast response flow control apparatus that may be retrofitted to existing fire protection/suppression systems.

Still another object of the present invention is to provide improved fast response flow control apparatus for use in high-speed fire protection/suppression systems that are economical to manufacture to provide for widespread use.

These and other objects are accomplished by a fast response fluid flow control valve/nozzle that generally comprises an assembly of six primary components. A chamber base provides a threaded connection for a typical high-speed fire protection/suppression piping system. The base forms one half of a chamber that is pressurized by the initiation of a commercially available actuation device that is connected to a port in the side of the base. A jet core is threaded into the chamber base to form the other half of the chamber. The jet core includes the channels connecting the chamber with the under side of a rupture (i.e. frangible) disc assembly. A disc retention ring holds the rupture disc assembly against the jet core. A nozzle port threads onto the chamber base applying the pressure to the disc retention ring to seat the rupture disc assembly and tie the components together as a complete assembly. The nozzle port also provides a threaded connection to facilitate the installation of a water spray nozzle. The final component is a pressure cartridge actuator threaded into the chamber base and used to generate the pressure required to rupture the disc assembly.

The fast response fluid flow control valve/nozzle according to the present invention combines the technology used to rupture the frangible discs found in pressurized container-based fire protection/suppression systems with that found in fixed pipe, high-speed spray/sprinkler systems. The present invention applies over-pressurization technology to a significantly smaller chamber contained within the fast response fluid flow control valve/nozzle that is virtually isolated from the essentially unlimited supply of fire extinguishing/suppressing material. The apparatus' design directs the over-pressurization created in the chamber through the channels in the jet core to create a small, localized pressure wave on the underside of the frangible disc. The pressure wave is, due to its localized nature, sufficient to rupture the disc in an extremely rapid manner without generating any flow disrupting back pressure that would delay the discharge of the fire extinguishing/suppressing material through the fast response fluid flow control valve/nozzle.

The present invention fulfills its purpose while significantly limiting the introduction of hazards (e.g. explosive devices) into the area it protects. The present invention is scalable to provide for use in a variety of applications, fabricated of materials that provide the durability/longevity required by the nature of its use, capable of being retrofitted to existing fire protection/suppression systems, and economical to manufacture in order to provide for widespread use.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
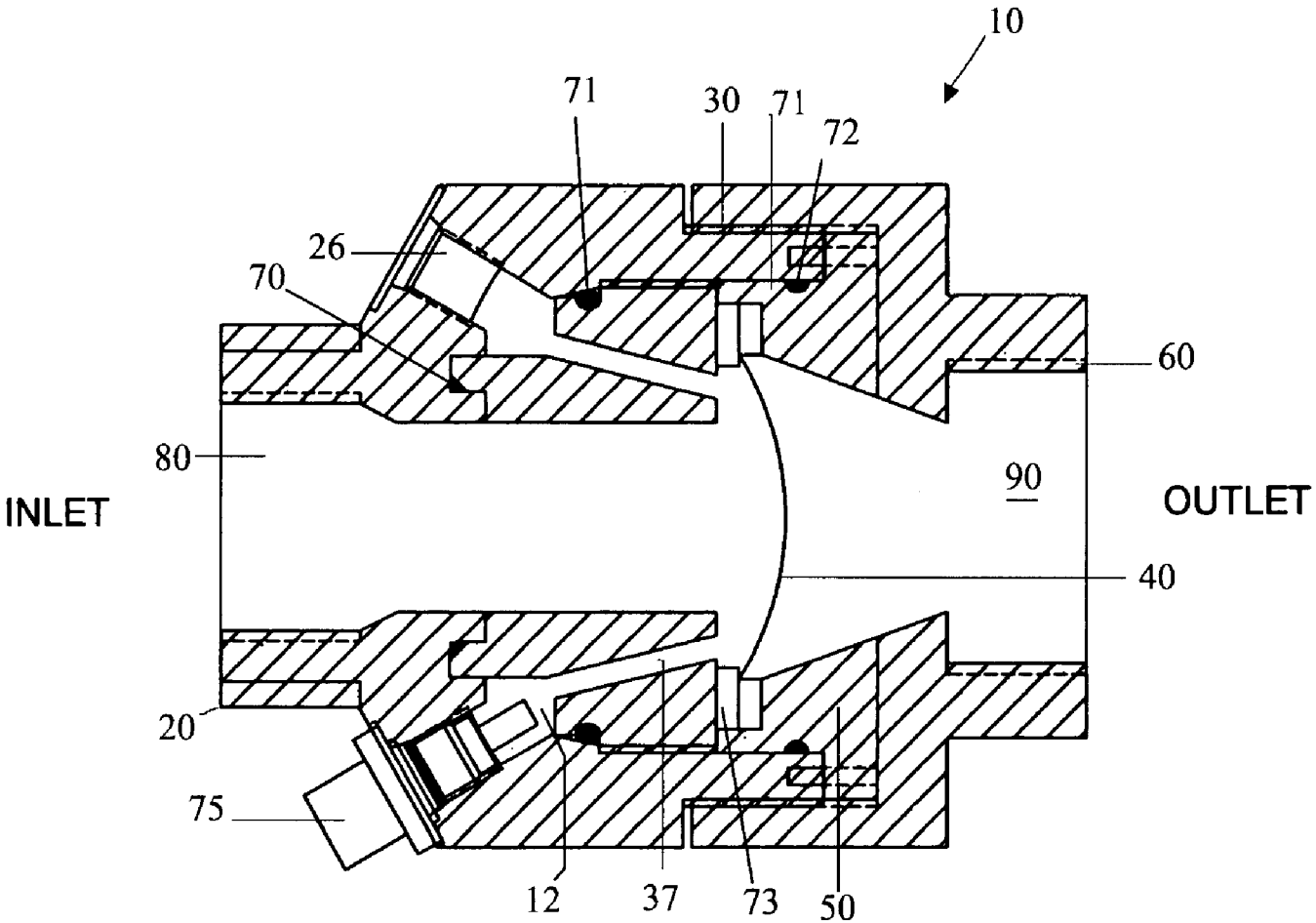
FIG. 1 is a side, cross-sectional view of a fast response fluid flow control valve/nozzle 10 according to a preferred embodiment of the present invention.
Figure 2:
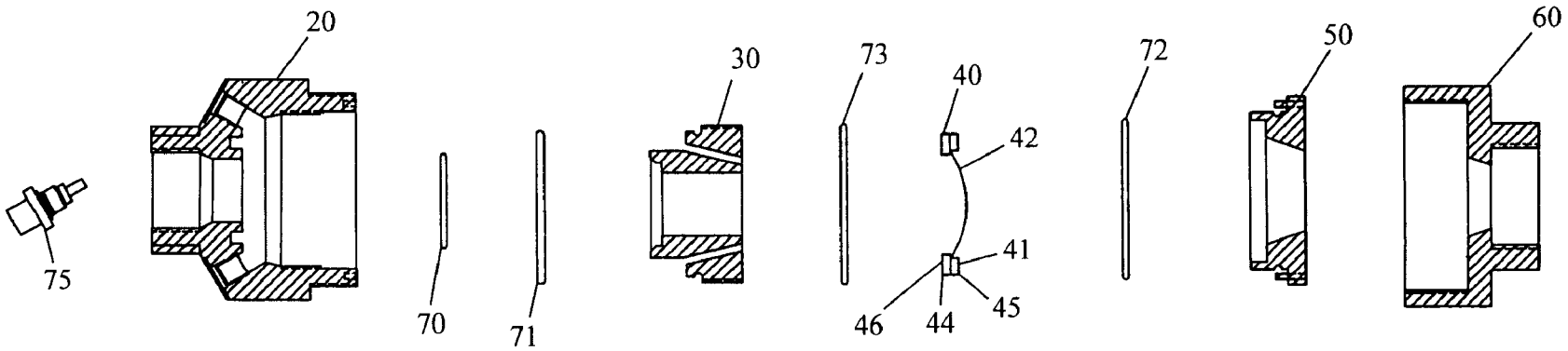
FIG. 2 is an exploded view of the fast response flow control valve/nozzle 10 as in FIG. 1.

FIGS. 1 and 2 are, respectively, side cross-sectional and exploded views of a fast response fluid flow control valve/nozzle 10 according to a preferred embodiment of the present invention. The fast response fluid flow control valve/nozzle 10 generally comprises a chamber base 20, a jet core 30, a frangible disc 40, a disc retention ring 50, a nozzle port 60, a plurality of o-rings 70–73, and a pressure cartridge 75.

Figure 3:
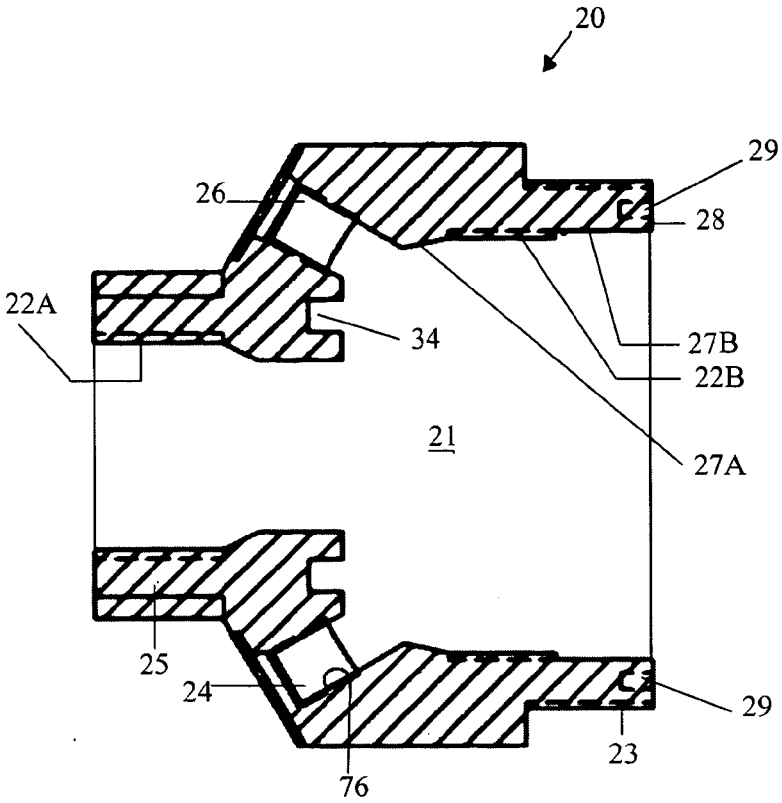
FIG. 3 is a side, cross-sectional view of a chamber base 20.
Figure 4:
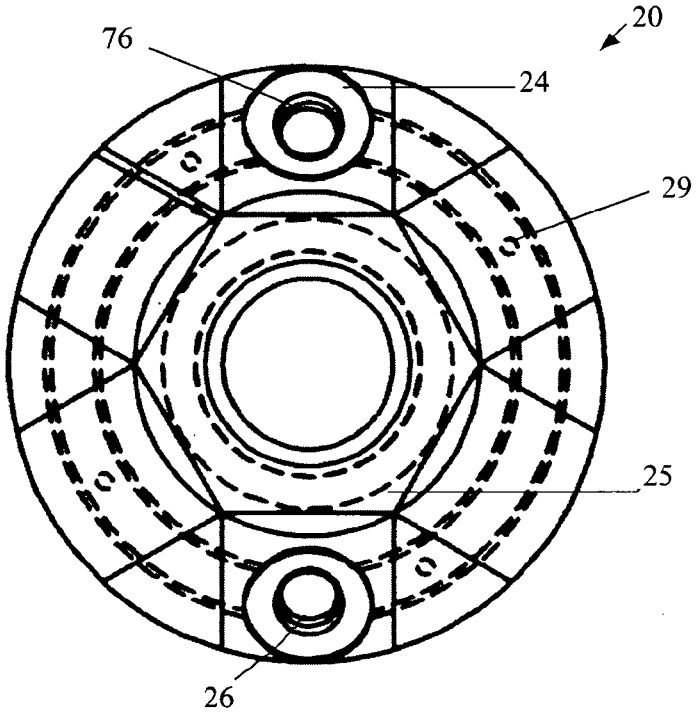
FIG. 4 is an end perspective view of the chamber base 20 as in FIG. 3.

As can be seen in FIGS. 3 and 4, the chamber base 20 comprises a base and outer walls of a chamber 21 of varying diameters, internal threads 22A at one end, internal threads 22B and external threads 23 at the opposite end, an actuator mounting port 24, an air bleed port 26, a plurality of key pin holes 29 formed in the end 28 proximate the external threads 23, and an o-ring groove 34. The actuator mounting port 24 and the air bleed port 26 are in fluid communication with the internal chamber 21 and positioned 180E apart on the external surface near the end with the internal threads 22A. The internal threads 22A represent the means (i.e. a fire suppressant inlet port 80—see FIG. 1) for creating a threaded connection between the valve/nozzle 10 and a typical high-speed fire protection/suppression piping system (not shown in the Figures). A hexagonal cross-section 25 is formed in the external surface of the chamber base 20, at the end that includes the internal threads 22A, to further facilitate the making of the aforementioned threaded connection. The chamber base 20 is preferably fabricated of commercially available, round stainless steel stock. However, other strong, yet lightweight, materials such as titanium may be utilized.

Figure 5:
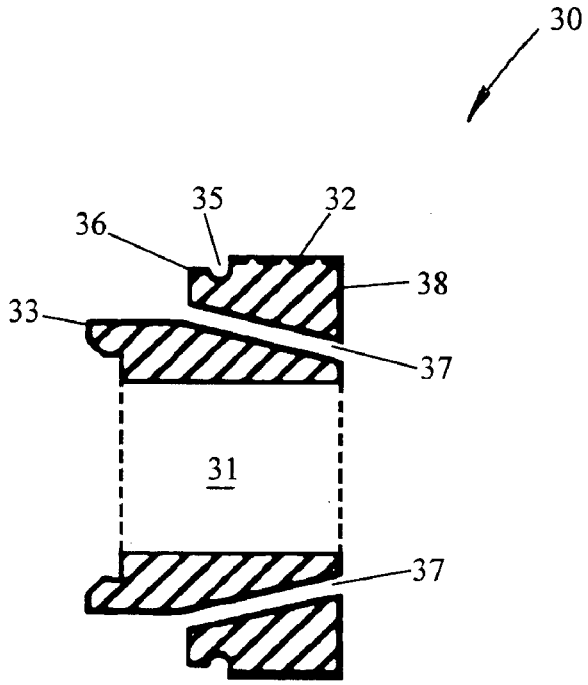
FIG. 5 is a composite front view (B) and side, cross-sectional view (A) of a jet core 30.
Figure 5:
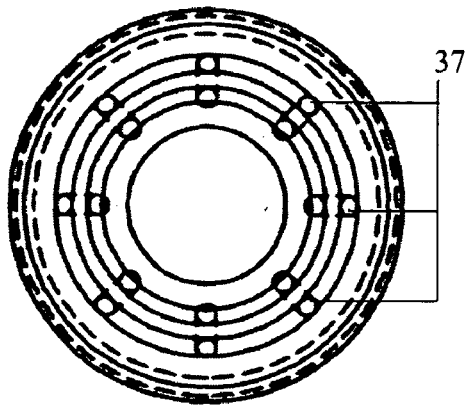

FIG. 5 is a composite front view (B) and side, cross-sectional view (A) of a jet core 30. The jet core 30 comprises a central bore 31, external threads 32 at one end 38, an o-ring groove 35 formed in its external surface 36, and a plurality of channels 37 formed to provide fluid communication between the external surface 36 and the end 38 proximate the external threads 32. The jet core 30 is preferably fabricated of commercially available, round stainless steel stock. However, other strong, yet lightweight, materials such as titanium may be utilized.

As shown in FIG. 2, the frangible disc 40 is preferably a rupture disc assembly commercially available from the Oklahoma Safety Equipment Company (OSECO) of Broken Arrow, OK. The disc assembly 40 generally comprises a stainless steel spherically curved disc 42 and a base 41 formed from two stainless steel rings 44, 45. The rings 44, 45 and disc 42 are fixedly attached (e.g. welded) in order to form the finished assembly 40. The disc assembly 40 is designed to rupture at a pressure of 300 PSI (OSECO's disc design provides for rupture pressures from 160 to 4,000 PSI as specified). Ring 44 includes an o-ring groove 46 to assist in providing a water-tight seal between the disc assembly 40 and the jet core 30.

Figure 6:
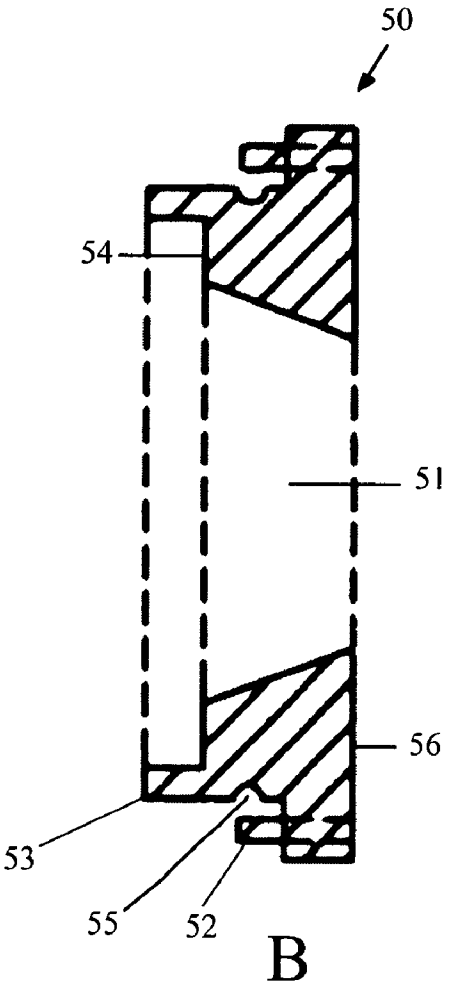
FIG. 6 is a composite front view (A) and side, cross-sectional view (B) of a retention ring 50.
Figure 6:
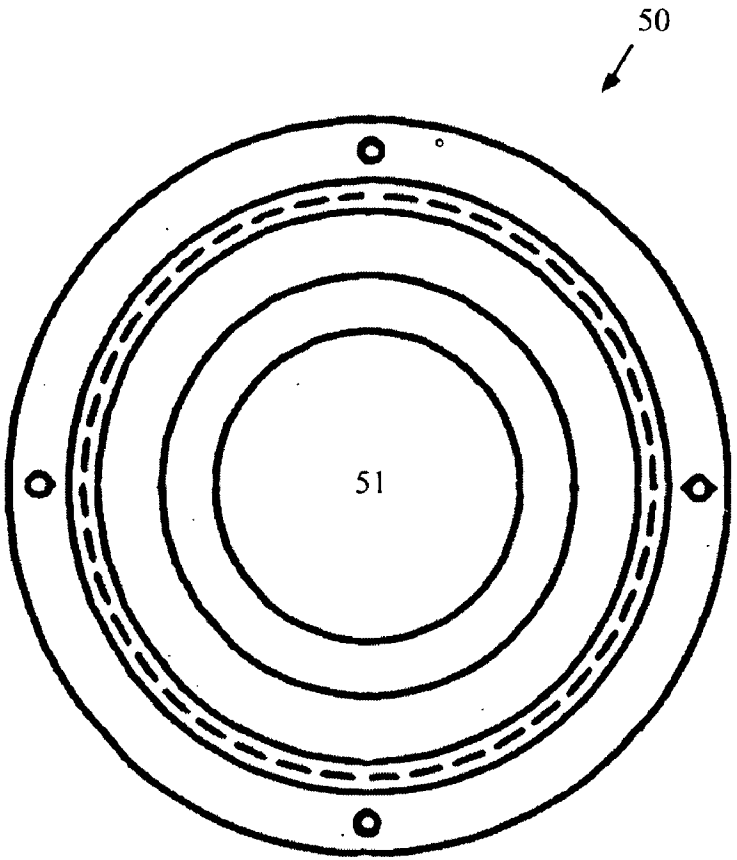

FIG. 6 is a composite front view (A) and side, cross-sectional view (B) of a retention ring 50. The disc retention ring 50 comprises a central bore 51, an o-ring groove 55 formed in its external surface 53, and a plurality of key pins 52 seated (e.g. press or friction fit) around the periphery of one end 56. The disc retention ring 50 is preferably fabricated of commercially available, round stainless steel stock. However, other strong, yet lightweight, materials such as titanium may be utilized.

Figure 7:
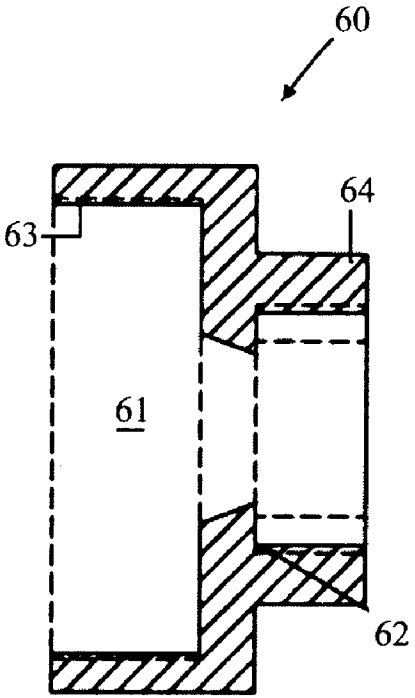
FIG. 7 is a composite side, cross-sectional view (B) and end perspective view (A) of a nozzle port 60.
Figure 7:
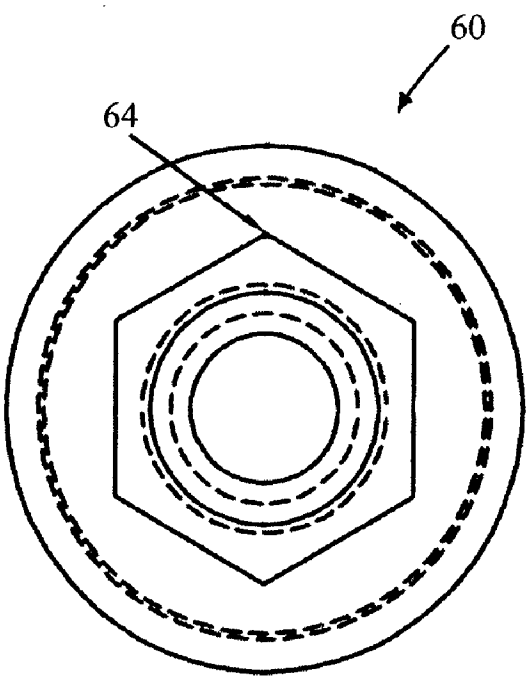

FIG. 7 is a composite side, cross-sectional view (B) and end perspective view (A) of a nozzle port 60. The nozzle port 60 comprises a central bore 61 of varying diameters and internal threads 62, 63 at both ends. The smaller diameter internal threads 62 represent the means for creating a threaded connection (i.e. a fire suppressant discharge port 90—see FIG. 1) between the valve/nozzle 10 and the spray/dispersion nozzle used in a typical high-speed fire protection/suppression system (not shown in the Figures). A hexagonal cross-section 64 is formed in the external surface of the nozzle port 60, at the end that includes the smaller diameter internal threads 62, to further facilitate the making of the aforementioned threaded connection. The nozzle port 60 is preferably fabricated of commercially available, round stainless steel stock. However, other strong, yet lightweight, materials such as titanium may be utilized.

As shown in FIGS. 1 and 2, the pressure cartridge actuator 75 is preferably a device commercially-available from McCormick Selph, Inc. of Hollister, CA under part no. 817444-5. Upon actuation, the cartridge 75 generates a pressure in excess of 300 PSI within the chamber base 20 and the channels 37 of the jet core 30 in order to rupture the disc assembly 40.

With collective reference to FIGS. 1–7, the fast response fluid flow control valve/nozzle 10 is assembled as follows. The two commercially-available o-rings 70, 71 are placed in the o-ring grooves 34, 35, respectively, found in the chamber base 20 and on the external surface 36 of the jet core 30. The jet core 30 is inserted into the internal chamber 21 of the chamber base 20 such that its external threads 32 engage the base's internal threads 22B. The chamber base 20 and jet core 30 are thus screwed together until the smaller o-ring 70 engages the leading end 33 of the jet core 30 and the larger o-ring 71 engages an angled internal surface 27A of the base 20. The base 41 of the disc assembly 40 is placed in position against an internal face 54 of the retention ring 50 such that its spherical surface 42 curves toward the face 54. O-rings 72, 73 are placed in grooves 55, 46, respectively. The combination of the retention ring 50, disc assembly 40, and o-rings 72, 73 is attached in a releasable manner to the previously created sub-assembly of the chamber base 20 and jet core 30 by aligning and engaging the plurality of key pins 52 on the retention ring 50 with the plurality of holes 29 formed in the chamber base 20. The joining of these components serves to compress o-ring 73 within groove 46 against end surface 38 of the jet core 30 and to engage o-ring 72 with an internal surface 27B of the chamber base 20, thereby trapping the disc assembly 40 between the core 30 and the ring 50. The nozzle port 60 is attached to the resulting sub-assembly by engaging the internal threads 63 of the nozzle port 60 with the external threads 23 of the chamber base 20. Finally, the cartridge actuator 75 is attached in a releasable manner to the chamber base 20 via the internal threads 76 located within the mounting port 24.

The operation of the valve/nozzle 10, after its installation in a typical fixed pipe high-speed fire protection/suppression system, once any entrapped air is removed from the chamber through bleed port 26 (a conventional bleeder valve can be used for this purpose but is not shown in Figures), is as follows. The valve/nozzle assembly 10 contains an internal chamber 12 that is pressurized to more than 300 PSI by the initiation of the cartridge actuator 75 upon the detection of a fire/explosion. The pressure wave created by the actuator's initiation is directed through the channels 37 and against the underside (i.e. convex) surface 42 of the frangible disc 40 in order to rupture the disc 40 and release the fire extinguishing/suppressing material that enters through inlet port 80 and exits through a dispersing nozzle attached to discharge port 90.

As is readily perceived in the foregoing description, the fast response fluid flow control valve/nozzle 10 of the present invention combines the technology used to rupture the frangible discs found in container-based fire protection/suppression systems with that found in fixed pipe, high-speed spray/sprinkler systems. The present invention applies over-pressurization technology to a significantly smaller chamber 12 contained within the fast response fluid flow control valve/nozzle 10 that is virtually isolated from the essentially unlimited supply of fire extinguishing/suppressing material. The design of the valve/nozzle 10 directs the over-pressurization created in the chamber 12 through the channels 37 in the jet core 30 to create a small, localized pressure wave on the underside of the frangible disc assembly 40. The pressure wave is, due to its localized nature, sufficient to rupture the disc assembly 40 in an extremely rapid manner without generating any flow disrupting back pressure that would delay the discharge of the fire extinguishing/suppressing material through the fast response fluid flow control valve/nozzle 10. The present invention is scalable to provide for use in a variety of applications, fabricated of materials that provide the durability/longevity required by the nature of its use, capable of being retrofitted to existing fixed pipe fire protection/suppression systems, and economical to manufacture in order to provide for widespread use.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A fast response flow control valve/nozzle for a high-speed fire protection/suppression system, comprising:

a base defining the outer walls of an internal chamber and comprising internal threads at a first end, external threads at said first end, and at least two mounting ports proximate said first end in fluid communication with said internal chamber;

a jet core defining the inner walls of an internal chamber and comprising external threads at a first end, said external threads at said first end being releasably attached to said internal threads at said first end of said base;

a frangible disc proximate said first end of said jet core and said first end of said base;

a retention ring releasably attached at said first end of said base, whereby said frangible disc is positioned between said retention ring and said first end of said jet core;

a nozzle port defining a central bore and comprising internal threads at a first end, said internal threads at said first end being releasably attached to said external threads at said first end of said base, thereby enclosing said jet core, said frangible disc, and said retention ring within said internal chamber of said nozzle port and said internal chamber of said base; and an actuator releasably attached to said base at one of said two or more mounting ports;

whereby initiation of said actuator creates a localized pressure wave sufficient to rupture said frangible disc to release a fire suppressing material.

2. The fast response flow control valve/nozzle according to claim 1 wherein said base further comprises internal threads at a second end for connection of said valve/nozzle to a source of fire suppressing material.

3. The fast response flow control valve/nozzle according to claim 1 wherein said base further comprises a plurality of key pin holes located around the periphery of said first end.

4. The fast response flow control valve/nozzle according to claim 3 wherein said base is fabricated of stainless steel.

5. The fast response flow control valve/nozzle according to claim 1 wherein said jet core further comprises a plurality of channels in fluid communication between an external surface and said first end, whereby said plurality of channels establishes fluid communication between said mounting ports in said base and said frangible disc.

6. The fast response flow control valve/nozzle according to claim 5 wherein said jet core is fabricated of stainless steel.

7. The fast response flow control valve/nozzle according to claim 5 wherein said frangible disc is in fluid communication with said plurality of channels in said jet core.

8. The fast response flow control valve/nozzle according to claim 7 wherein said frangible disc comprises a base fixedly attached to a spherically curved disc.

9. The fast response flow control valve/nozzle according to claim 8 wherein said base and said spherically curved disc are fabricated of stainless steel.

10. The fast response flow control valve/nozzle according to claim 3 wherein said retention ring further comprises a plurality of key pins located around its periphery, said plurality of key pins being located to align and slidably engage said key pin holes in said first end of said base, thereby holding said frangible disc in position between said retention ring and said jet core.

11. The fast response flow control valve/nozzle according to claim 10 wherein said retention ring is fabricated of stainless steel.

12. The fast response flow control valve/nozzle according to claim 1 wherein said nozzle port further comprises internal threads at a second end for connection of said valve/nozzle to a dispersing nozzle for the fire suppressing material.

13. The fast response flow control valve/nozzle according to claim 12 wherein said nozzle port is fabricated of stainless steel.

* * * * *